US006939195B1

(12) United States Patent
Hunt et al.

(10) Patent No.: US 6,939,195 B1
(45) Date of Patent: Sep. 6, 2005

(54) TOY ANIMAL WITH SIMULATED RESPIRATION

(75) Inventors: Ronald Eugene Hunt, Georgetown, TX (US); Verlon Eugene Whitehead, Austin, TX (US)

(73) Assignee: CD3 Storage Systems, Inc., Austin, TX (US)

( * ) Notice: Subject to any disclaimer, the term of this patent is extended or adjusted under 35 U.S.C. 154(b) by 0 days.

(21) Appl. No.: 10/956,577

(22) Filed: Oct. 1, 2004

(51) Int. Cl.[7] ..... A63H 3/00
(52) U.S. Cl. ..... 446/295; 446/330; 446/353
(58) Field of Search ..... 446/236, 268, 446/295, 308, 320, 330, 353, 358, 365, 370, 446/373, 484, 309, 352, 382

(56) References Cited

U.S. PATENT DOCUMENTS 1,796,483 A * 3/1931 Schoder ..... 446/353
2,859,731 A * 11/1958 Sutton ..... 119/174
2,954,642 A * 10/1960 Jackson ..... 446/295
3,110,980 A * 11/1963 Moormann ..... 446/295
3,574,968 A * 4/1971 Schlau et al. ..... 446/97
4,662,855 A * 5/1987 Morrison ..... 446/227
4,718,876 A * 1/1988 Lee ..... 446/295
5,006,089 A * 4/1991 Lee ..... 446/267
6,238,263 B1 * 5/2001 Bennett ..... 446/330
6,695,673 B1 * 2/2004 Stadbauer ..... 446/305

* cited by examiner

*Primary Examiner*—Bena Miller
(74) *Attorney, Agent, or Firm*—Andrew J. Dillon; Dillon & Yudell LLP

(57) ABSTRACT

A toy animal formed of molded plastic provides simulated respiration. An aperture in the upper section of the molded plastic animal is covered with a flexible simulated animal pelt. A battery-powered electric motor within the toy animal provides a rotating output which is coupled to the underside of the flexible simulated animal pelt within the aperture utilizing a flexible shaft. This manner rotation of the motor output alternately extends and depresses the flexible simulated animal pelt, thereby simulating respiration.

10 Claims, 4 Drawing Sheets

TOY ANIMAL WITH SIMULATED RESPIRATION

BACKGROUND OF THE INVENTION

1. Technical Field

The present invention relates in general to toys and in particular to animal toys. Still more particularly, the present invention relates to an animal toy which simulates respiration.

2. Description of the Related Art

Toy animals are well-known in the art and have existed for many thousands of years. Attempts have been made over the years to provide a more life-like appearance for such toy animals. For example, U.S. Pat. No. 5,006,089 discloses a life-like toy animal which is provided by stuffing an animal-shaped toy with a closed fluid containing liner filled with a viscous silicone or silicone/water material. The weight of the silicone/water material is believed to give the animal a life-like weight and, when covered with a fur-like plush, a toy constructed in the manner disclosed within this patent may appear life-like and satisfy the desires of people or children to fantasize a friendship with a live animal without the costly and time consuming impact of maintaining a live animal.

In an effort to produce an even more life-like toy animal, various mechanical animal reproductions have been proposed. For example, U.S. Pat. No. 6,695,673 discloses a mechanical dog having a head and tongue which, when utilized in conjunction with a tank and a pumping device, can simulate, in a life-like manner, the lapping of fluid by a live animal.

Toys, both animal simulative or not, are also frequently utilized to soothe or distract a child by producing vibrations or sounds which are intended to be life-like. One example of such a device may be seen in U.S. Pat. No. 6,238,263.

One attempt at producing an animal toy having a life-like appearance which conforms to actual biologic functions may be seen in U.S. Pat. No. 4,718,876. This patent discloses a stuffed animal containing a heartbeat simulating transducer, which in combination with an electronic circuit, provides a simulated heartbeat which can have a comforting and stimulating affect on young children, puppies or other creatures.

One problem with such devices is that the level of activity which is attempted to be reproduced is such that substantial electric power is consumed such that the device may be operated for only limited amounts of time.

It should therefore be apparent that a need exists for a life-like toy animal which simulates an actual animal in a manner which is highly efficient in terms of consumption of electric power but which still provides a calming, soothing representation of a live animal.

SUMMARY OF THE INVENTION

It is therefore one object of the present invention to provide an improved toy.

It is another object of the present invention to provide an improved life-like animal toy.

It is yet another object of the present invention to provide an improved animal toy which simulates respiration.

The foregoing objects are achieved as is now described. A toy animal is formed of molded plastic, which can provide simulated respiration. An aperture in the upper surface of the molded plastic animal is covered with a flexible simulated animal pelt. A battery-powered electric motor is placed within a cavity within the molded plastic toy animal which provides a rotating output. That rotating output is then coupled to the underside of the flexible simulated animal pelt within the aperture utilizing a flexible shaft such that rotation of the motor rotary output alternately extends and depresses the flexible simulated animal pelt, thereby simulating respiration.

BRIEF DESCRIPTION OF THE DRAWINGS

The novel features believed characteristics of the invention are set forth in the appended claims. The present invention itself, however, as well as a preferred mode of use, further objectives, and advantages thereof, will best be understood by reference to the following detailed description of a preferred embodiment when read in conjunction with the accompanying drawings, wherein:

DETAILED DESCRIPTION OF THE PREFERRED EMBODIMENT

Figure 1:
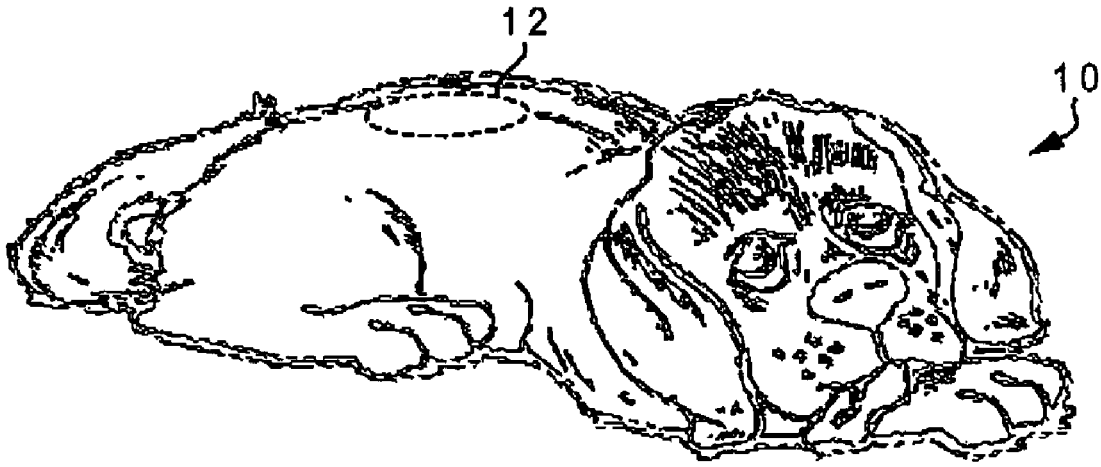
FIG. 1 is a perspective view of a toy animal constructed in accordance with the present invention.

With reference now to the figures and in particular with reference to FIG. 1, there is depicted a toy animal 10 which is constructed in accordance with the teaching of the present invention. As illustrated, toy animal 10 may comprise a puppy; however, toy animal 10 may also comprise a cat, teddy bear, frog or any other fanciful animal representation. As illustrated, an aperture 12 is provided in the upper surface of a toy animal 10 which will be utilized to simulate respiration in the manner which will be described herein.

Figure 2:
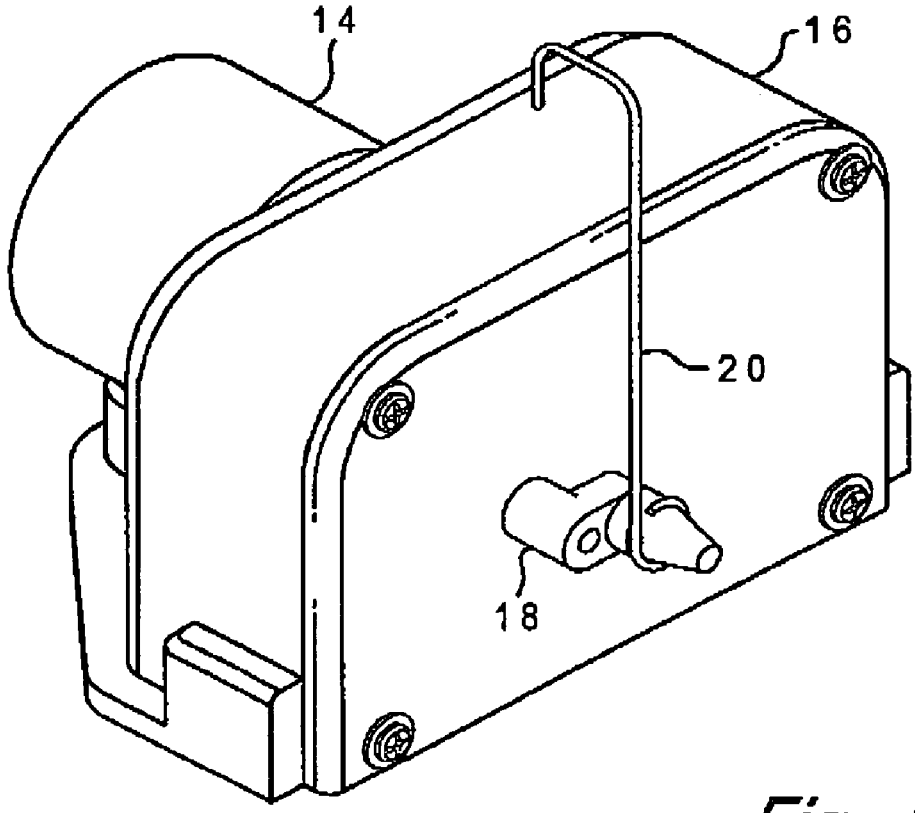
FIG. 2 is a perspective view of an electric motor and gearbox utilized to implement the present invention.

Referring now to FIG. 2, there is depicted a perspective view of an electric motor and gear box utilized to implement the present invention. As illustrated, a gearbox 16 is coupled to an output shaft (not shown) of electric motor 14. The output of gearbox 16 is a rotating drive crank 18 and, as illustrated, a flexible shaft 20 is coupled to rotating drive crank 18. In the depicted embodiment of the present invention, flexible shaft 20 is preferably is made from a high quality spring steel with a modulus of elasticity equal to $30\times10^{6}$ psi and an elastic limit greater than 200,000 psi. The flexible shaft 20 L/D ratio, that is, the ratio of the length of flexible shaft 20 and the diameter of flexible shaft 20, is in the range of 50 to 100. This high ratio allows easy bending of flexible shaft 20 without it reaching the elastic limit that would result in permanent deformation. The high ratio also allows easy buckling of the flexible shaft 20 when it receives a high column load, permitting flexible shaft 20 to flex under load, as will be described in greater detail herein.

Figure 3:
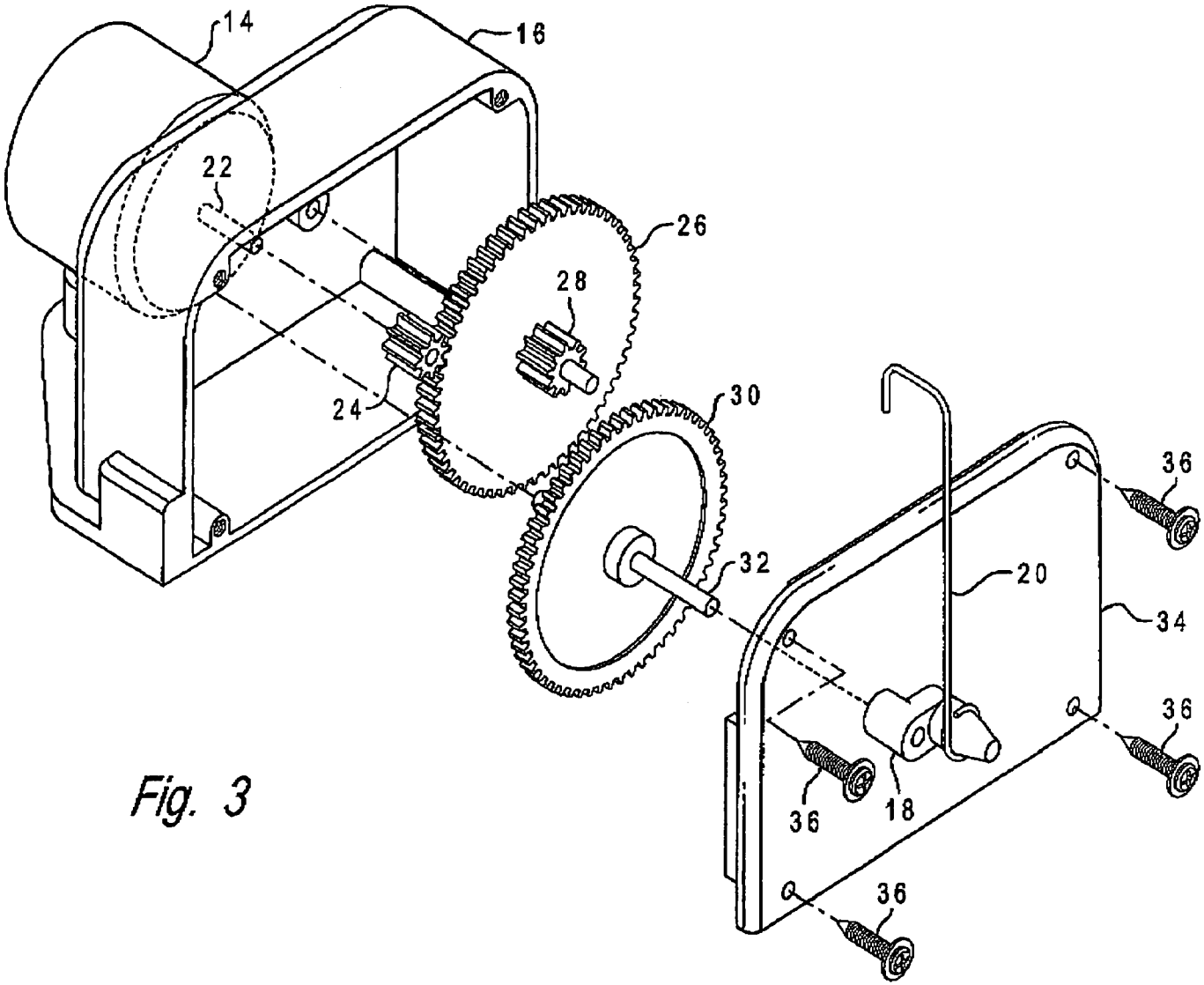
FIG. 3 is an exploded view of the electric motor and gearbox of FIG. 2.

With reference now to FIG. 3, there is depicted an exploded view of the electric motor and gear box of FIG. 2. As illustrated, electric motor 14 includes a motor shaft 20, which, in the depicted embodiment of the present invention, is utilized to rotate pinion gear 24. Pinion gear 24 is depicted as meshing with bull gear 26 and, as graphically depicted in FIG. 3, serves to provide an initial reduction of the rotation speed of motor shaft 22, as those having ordinary skill in the art will appreciate.

Rotating with bull gear 26 is reduction gear 28. As illustrated, reduction gear 28 meshes with second bull gear 30 and further reduces the rotation speed output by motor 14. Second bull gear 30, preferably rotates about an idler shaft 32 and idler shaft 32 is coupled to rotating drive crank 18.

Gearbox cover 34 is held in place by a plurality of assembly screws 36 and, when assembled in the manner described within this figure, the output speed of motor 14 is preferably reduced by a factor of between 50 and 100.

Electric motor 14, in the depicted embodiment of the present invention, is preferably a battery-powered electric motor designed to draw very little current and thus be operable by ordinary flashlight batteries for an extended period of time.

Figure 4:
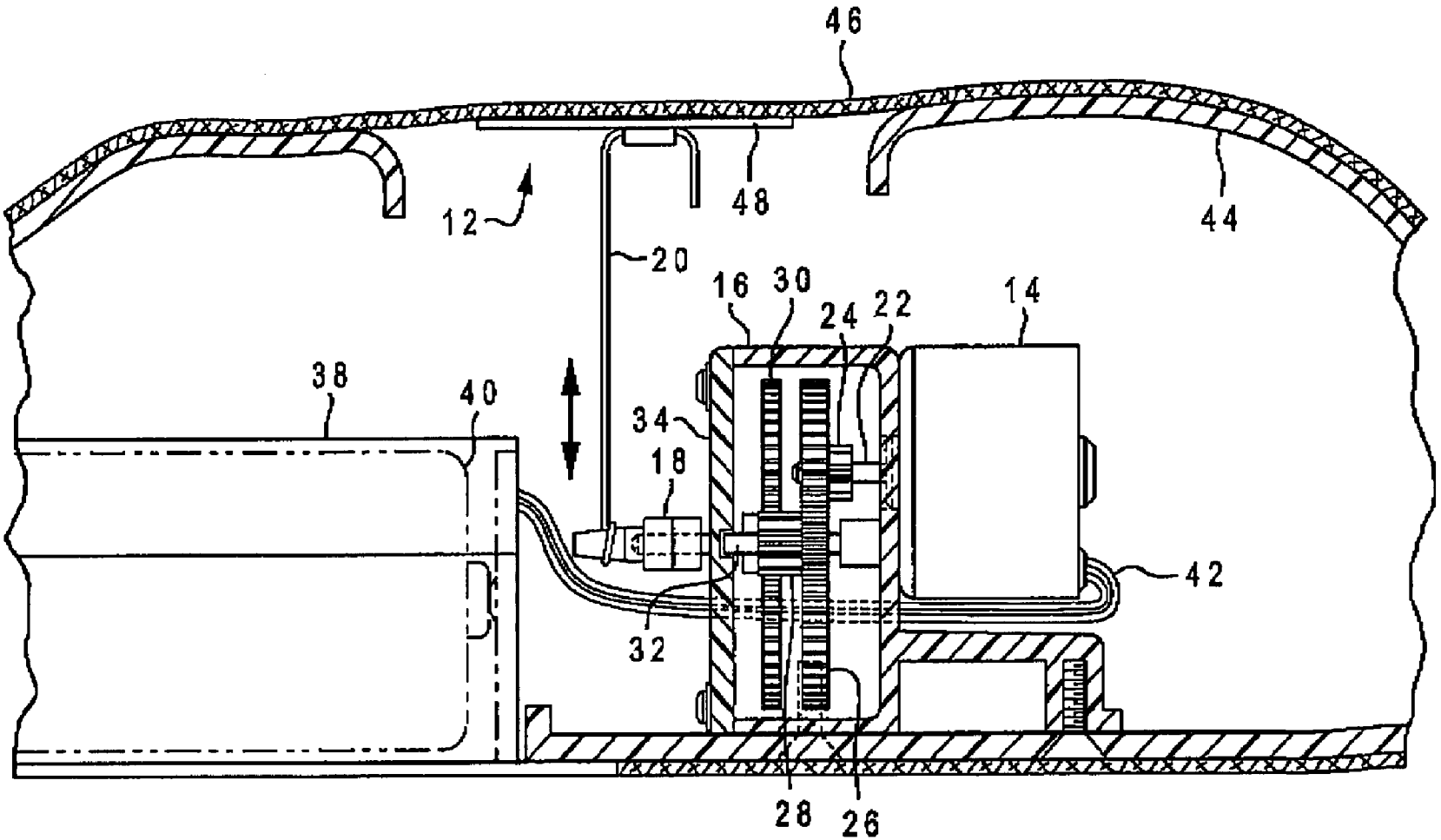
FIG. 4 is a sectional view of the electric motor and gear box mounted within the toy animal of the present invention.

Referring now to FIG. 4, there is depicted a sectional view of the electric motor and gearbox of the present invention mounted within toy animal 10. As depicted, electric motor 14 is mounted within a cavity within toy animal 10. In the depicted embodiment, toy animal 10 is preferably a molded plastic representation of an animal which may be constructed of polyvinyl chloride other suitable plastic material. As illustrated, aperture 12 and plastic mold 44 are covered on at least the upper surface thereof by simulated animal pelt 46. Although simulated animal pelt 46 is depicted having minimal thickness, those having ordinary skill in the art will appreciate that artificial fur or actual fur may be utilized to simulate an animal pelt having substantial thickness, dependent upon the animal type which is the subject of the present simulation. Additionally, that portion of simulated animal pelt 46 which overlies aperture 12 is preferably flexible in nature, permitting extension and depression in a manner which will be described in detail herein.

As illustrated, motor 14 and gearbox 16 with the associated reduction gear train are mounted within a cavity within toy animal 10 and flexible shaft 20 is coupled at one end to rotating drive crank 18 and at a second end to mounting plate 48. Mounting plate 48 is fixed, utilizing any suitable technique, to the underside of the flexible portion of simulated animal pelt 46 within aperture 12.

Also depicted within FIG. 4 is battery case 38 which serves to contain and electrically align one or more ordinary batteries which provide electrical power, via power cables 42 to electric motor 14.

Figure 5:
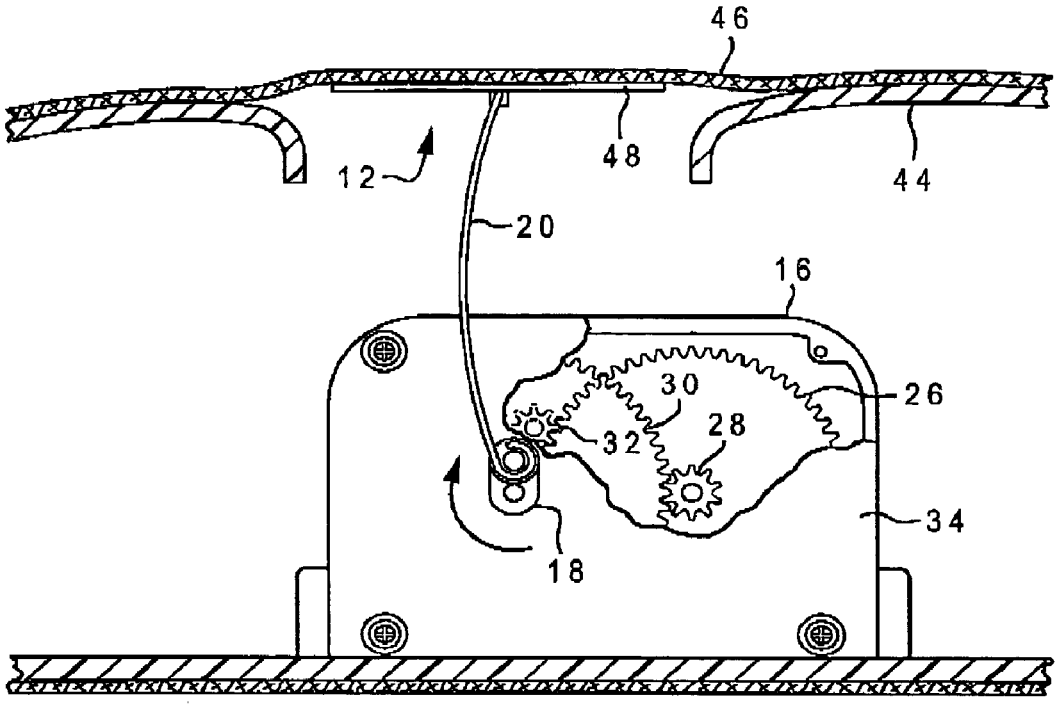
FIG. 5 is a partial cut-away sectional view of the extension of the body of the toy animal of the present invention.

Next, with reference to FIG. 5, there is depicted a partial cutaway sectional view of the extension of simulated pelt 46 of toy animal 10 of the present invention. As illustrated, rotation of rotating drive crank 18 moves flexible shaft 20 in an upward direction, causing the extension of simulated pelt 46 in the manner depicted. An important feature of the present invention is the provision of flexible shaft 20 utilizing a material which is sufficiently flexible such that the placing of an operator's hand or weight on the upper surface of simulated pelt 46 will not unduly load motor 14 when rotating drive crank 18 rotates, as a result of the tendency of flexible shaft 20 to bend, as illustrated within this figure.

Figure 6:
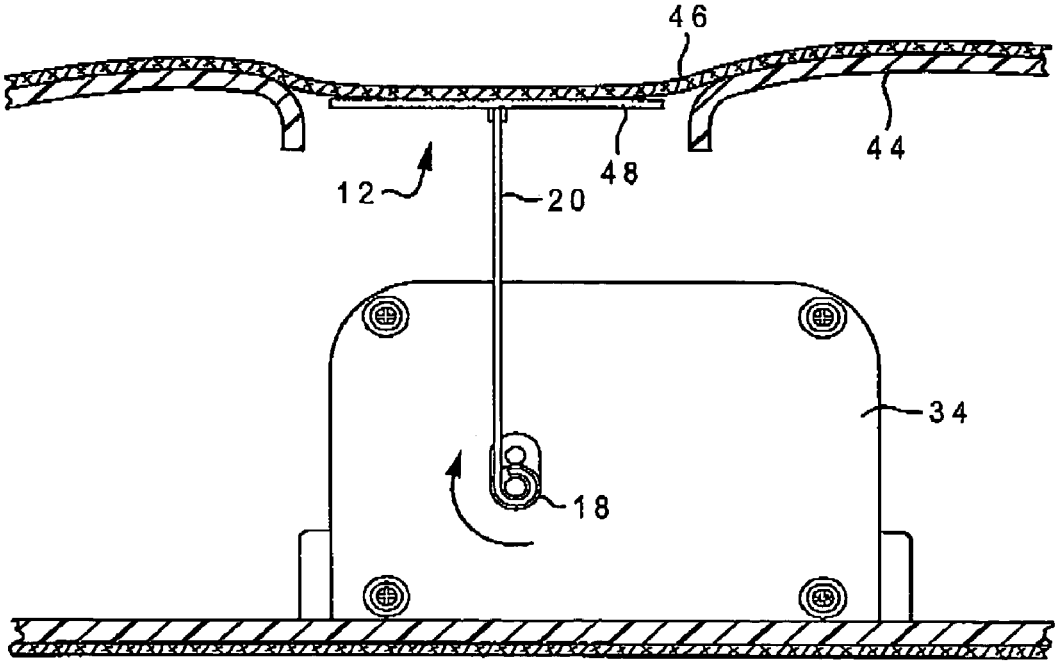
FIG. 6 is a partial sectional view of the depression of the body of the toy animal of the present invention.

Finally, referring to FIG. 6, there is depicted a partial sectional view of the depression of simulated animal pelt 46 into the body of toy animal 10. As illustrated, the rotation of rotating drive crank 18 to its lower-most position will move flexible shaft 20 in a downward direction and, via the attachment to mounting plate 48, will result in the depression of flexible simulated animal pelt 46 into aperture 12.

Thus, upon reference to the foregoing, those having ordinary skill in the art will appreciate that the applicants herein have provided a toy animal which, in a highly efficient manner, simulates respiration of a live animal in a manner calculated to soothe and amuse small children, puppies or other creatures. By utilizing a low current electric motor and a flexible shaft which will not bog down in response to a resistance against distention of the flexible portion of simulated pelt 46, the toy animal of the present invention can operate for periods of up to six months utilizing two common flashlight batteries.

While the invention has been particularly shown and described with reference to a preferred embodiment, it will be understood by those skilled in the art that various changes in form and detail may be made therein without departing from the spirit and scope of the invention.

What is claimed is:

1. A toy animal having simulated respiration, said toy animal comprising:

an animal-shaped mold having a cavity therein;

an aperture located within a surface of said animal-shaped mold;

a simulated animal pelt covering at least an upper surface of said animal-shaped mold, said simulated animal pelt including a flexible portion overlying said aperture;

an electric motor disposed within said cavity within said animal-shaped mold, said electric motor having a rotating output; and a flexible shaft connecting said rotating output of said electric motor and said flexible portion of said simulated animal pelt such that rotation of said rotating output alternately extends and depresses said flexible portion of said simulated animal pelt, thereby simulating respiration.

2. The toy animal according to claim 1, wherein said animal-shaped mold comprises a hollow animal-shaped plastic mold.

3. The toy animal according to claim 2, wherein said animal-shaped plastic mold is constructed of polyvinyl chloride.

4. The toy animal according to claim 2, wherein said animal-shaped plastic mold comprises a hollow dog-shaped plastic mold.

5. The toy animal according to claim 1, wherein said electric motor comprises a battery-powered low current drain electric motor.

6. The toy animal according to claim 1, wherein said rotating output comprises a rotating crank lever.

7. The toy animal according to claim 1, wherein said flexible shaft comprises a bendable wire having sufficient flexibility such that said rotating output would continue to rotate despite temporarily immobility of said flexible portion of said simulated animal pelt.

8. The toy animal according to claim 5, further including a battery case mounted within said animal-shaped mold.

9. The toy animal according to claim 1 further including a reduction gear train interposed between said electric motor and said rotating output.

10. The toy animal according to claim 9, wherein said reduction gear train reduces the rotational output of said battery-powered electric motor by a factor of 100.

* * * * *